US007862346B1

(12) United States Patent
Wan et al.

(10) Patent No.: US 7,862,346 B1
(45) Date of Patent: Jan. 4, 2011

(54) SOCKET CONNECTOR

(75) Inventors: Wei Wan, Hsin-Tien (TW); Shu-Lin Duan, Hsin-Tien (TW); Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/569,967

(22) Filed: Sep. 30, 2009

(30) Foreign Application Priority Data

Aug. 24, 2009 (TW) ..... 98215587 U

(51) Int. Cl.
*H01R 12/00* (2006.01)

(52) U.S. Cl. ..... 439/79; 439/607.04

(58) Field of Classification Search ..... 439/79, 439/607.4, 607.54, 660, 676
See application file for complete search history.

(56) References Cited

U.S. PATENT DOCUMENTS 7,614,920 B1 * 11/2009 Yi ..... 439/682
7,641,519 B1 * 1/2010 Chen ..... 439/660
7,654,871 B2 * 2/2010 Yi et al. ..... 439/660
7,682,163 B2 * 3/2010 Hou et al. ..... 439/79
7,686,656 B2 * 3/2010 Zheng et al. ..... 439/660

* cited by examiner

*Primary Examiner*—Thanh-Tam T Le
(74) *Attorney, Agent, or Firm*—Alan Kamrath; Kamrath & Associates PA

(57) ABSTRACT

A socket connector has an insulative housing, multiple first terminals, multiple second terminals, a positioning bracket and a shell. The first and second terminals are mounted through the insulative housing, and each of the first and second terminals has a mounting section, a soldering section and a contacting section. The soldering sections of all terminals are arranged in a transverse row relative to the insulative housing. The positioning bracket is mounted under the insulative housing and holds the soldering sections. The shell covers the insulative housing, first and second terminals and positioning bracket. The soldering sections arranged in one row makes the socket connector compact.

10 Claims, 8 Drawing Sheets

SOCKET CONNECTOR

BACKGROUND OF THE INVENTION

1. Field of the Invention

The present invention relates to a connector and, more particularly, to a socket connector that is compact and assembled quickly and easily.

2. Description of Related Art

Conventional Universal Serial Bus (USB) 2.0 connectors are popularly used in various electronic devices. However, the USB 2.0 protocol only allows a maximum transmission speed of 480 Mbps. Because electronic devices are constantly developed to increase transmission speed thereof, the USB 2.0 protocol does not meet the current transmission speed requirement of new electronic devices. Therefore, the USB Implementers Forum sets up a USB 3.0 protocol that may achieve a theoretical maximum transmission speed of 5 Gbps.

However, a USB 3.0 connector having two rows of terminals is structurally complicated so that manufacturing a qualifying USB 3.0 connector is difficult. The total length of the USB 3.0 connector is elongated due to the rows of terminals and, therefore, broadens the USB 3.0 connector. Furthermore, the terminals of the USB 3.0 connector generate crosstalk to interfere with each other when transmitting high frequency signals. Therefore, the USB 3.0 connector has a low production rate and a high manufacturing cost.

To overcome the shortcomings, the present invention provides a socket connector to mitigate or obviate the aforementioned problems.

SUMMARY OF THE INVENTION

The main objective of the invention is to provide a socket connector that is compact and assembled quickly and easily.

A socket connector in accordance with the present invention has an insulative housing, multiple first terminals, multiple second terminals, a positioning bracket and a shell. The first and second terminals are mounted through the insulative housing, and each of the first and second terminals has a mounting section, a soldering section and a contacting section. The soldering sections of all terminals are arranged in a transverse row relative to the insulative housing. The positioning bracket is mounted under the insulative housing and holds the soldering sections. The shell covers the insulative housing, first and second terminals and positioning bracket. The soldering sections are arranged in one row making the socket connector compact.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
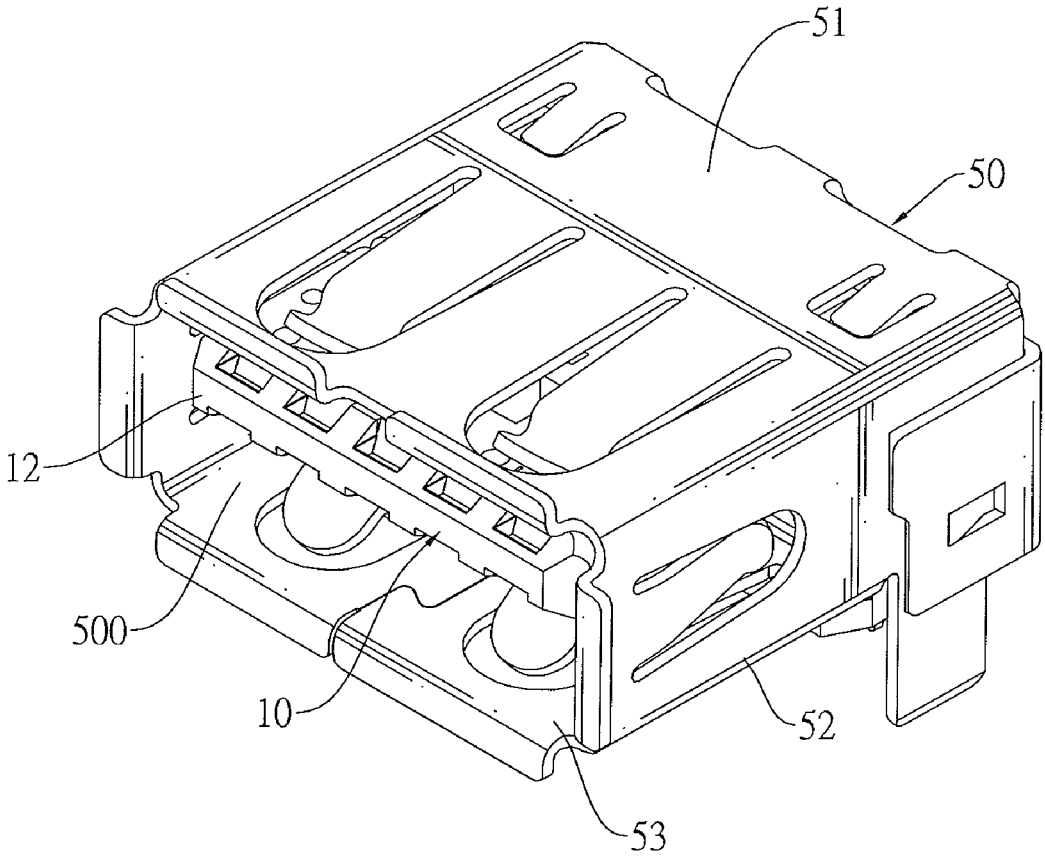
FIG. 1 is a top perspective view of a socket connector in accordance with the present invention.
Figure 2:
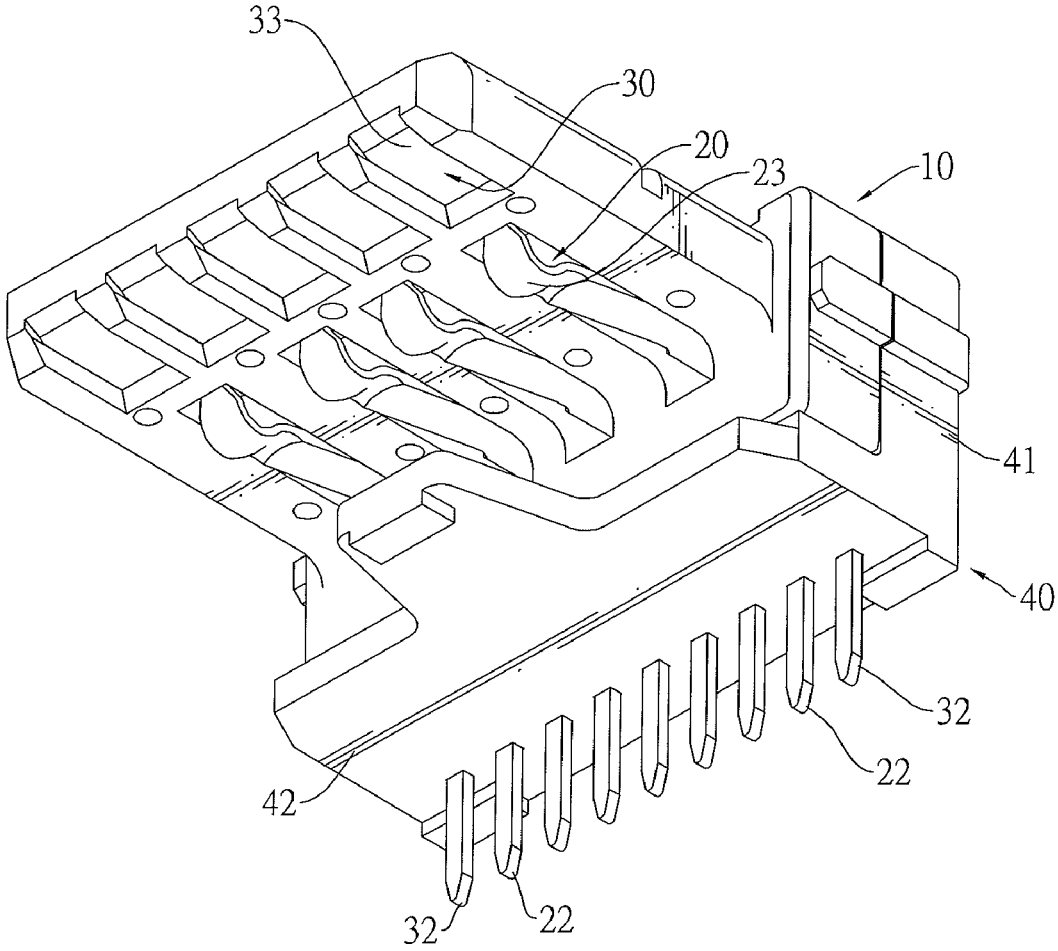
FIG. 2 is a bottom perspective view of the socket connector in FIG. 1 omitting a shell.
Figure 3:
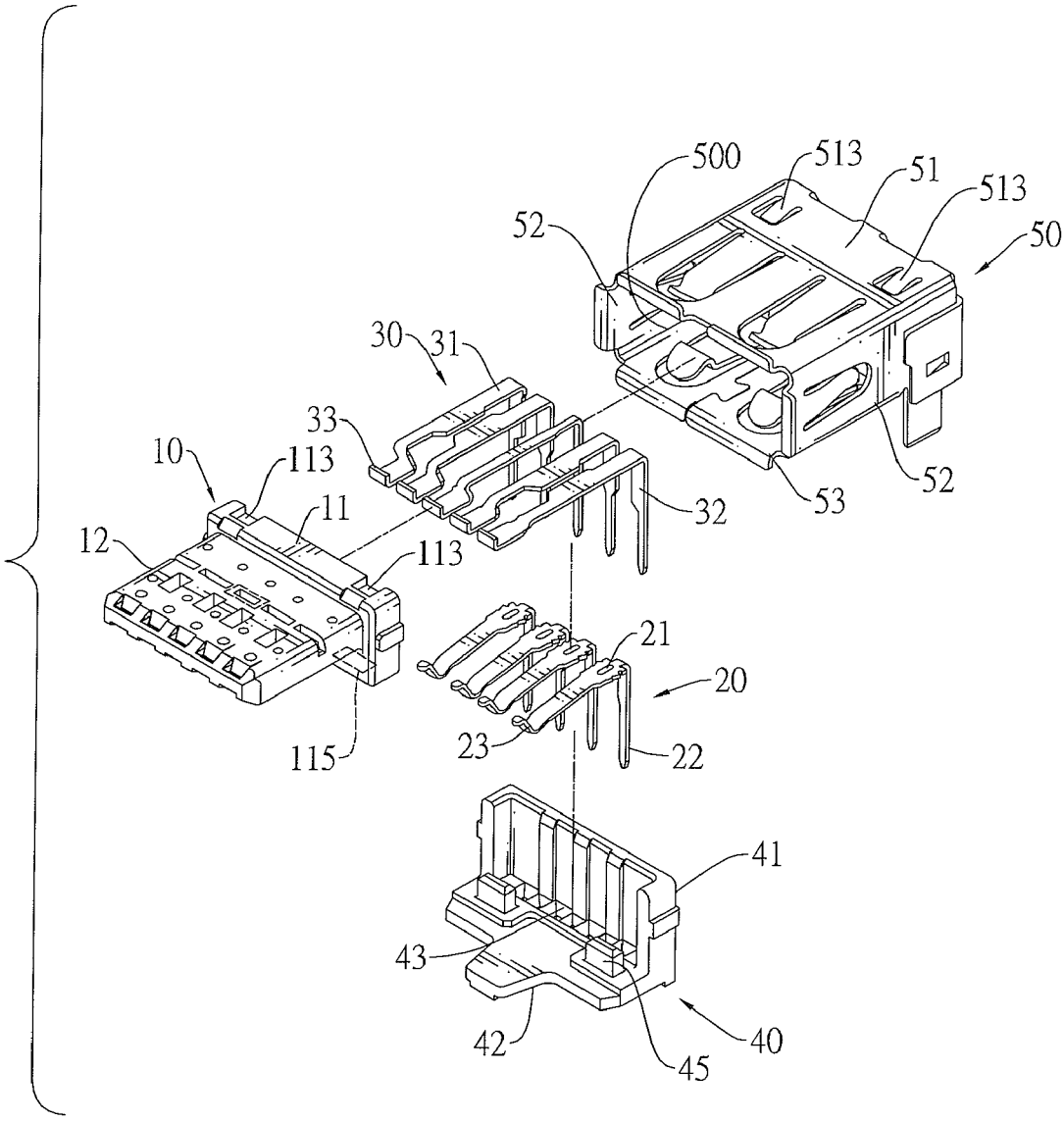
FIG. 3 is an enlarged front perspective view of the socket connector in FIG. 1.
Figure 4:
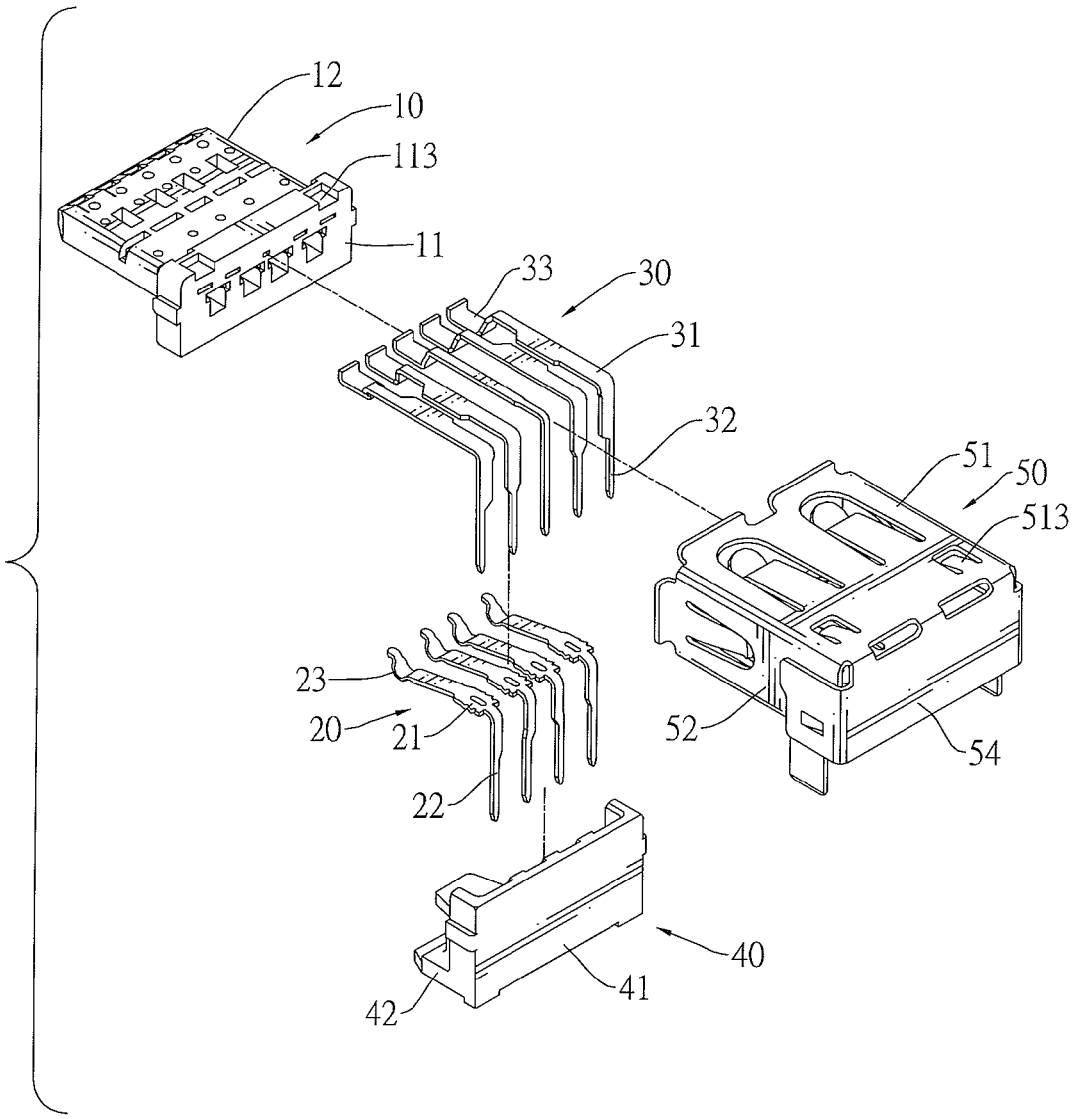
FIG. 4 is an enlarged rear perspective view of the socket connector in FIG. 3.

With reference to FIGS. 1 to 4, a socket connector in accordance with the present invention may comply with the USB 3.0 protocol and comprises an insulative housing (10), multiple first terminals (20), multiple second terminals (30), a positioning bracket (40) and a shell (50).

The insulative housing (10) has a base (11), a tongue (12), multiple first mounting holes (102) and multiple second mounting holes (103).

The base (11) has a top, a bottom and a front and may further have multiple positioning slots (113) and multiple fastening slots (115). The positioning slots (113) are defined in the top of the base (11). The fastening slots (115) are defined in the bottom of the base (11).

Figure 5:
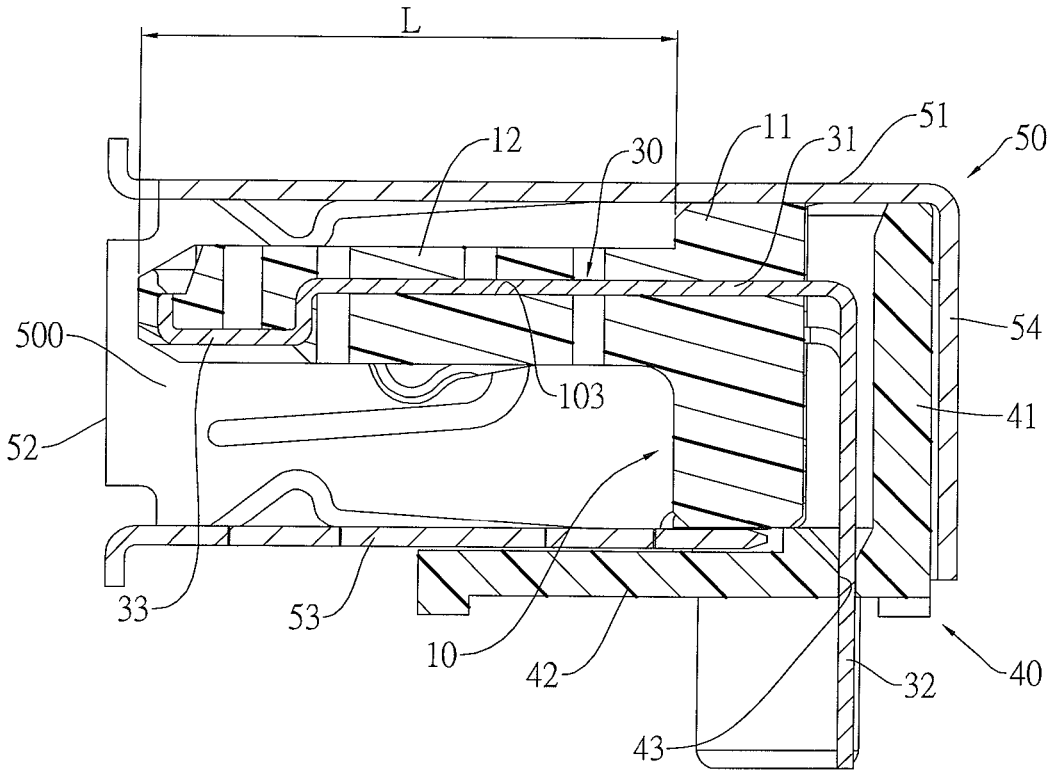
FIG. 5 is a cross sectional side view of the socket connector in FIG. 1.
Figure 6:
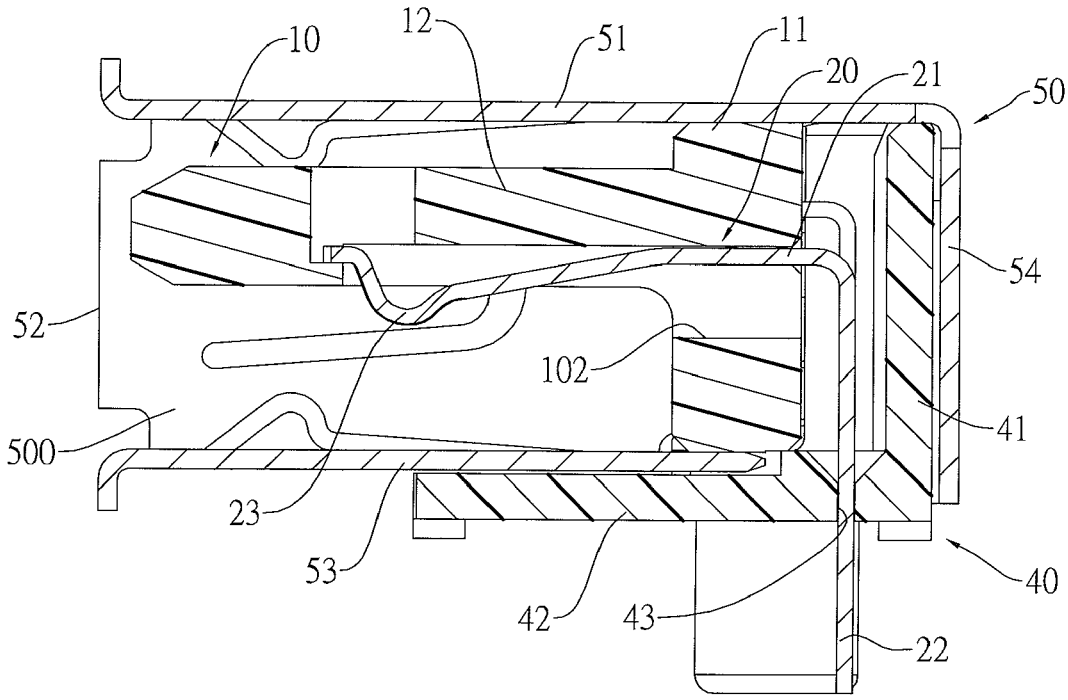
FIG. 6 is another cross sectional side view of the socket connector in FIG. 1.
Figure 7:
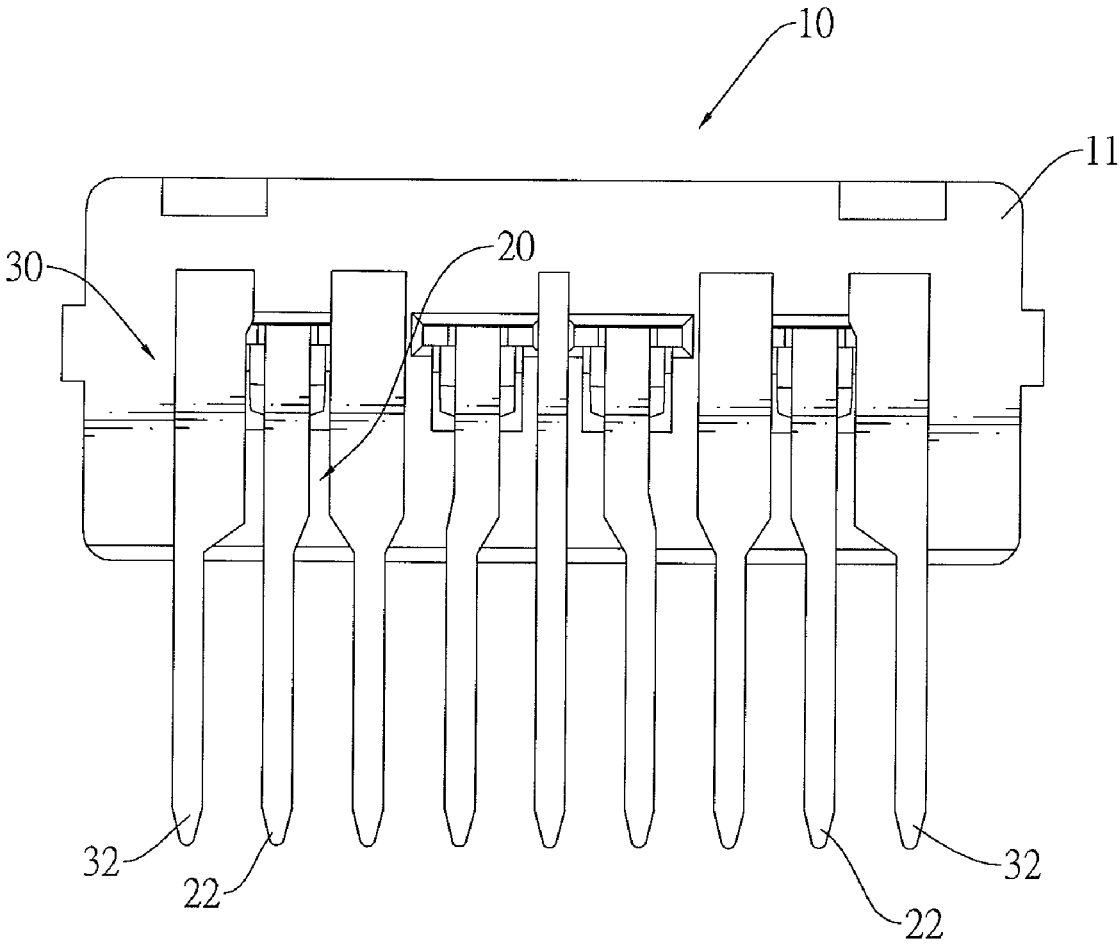
FIG. 7 is a rear view of the socket connector in FIG. 1.
Figure 8:
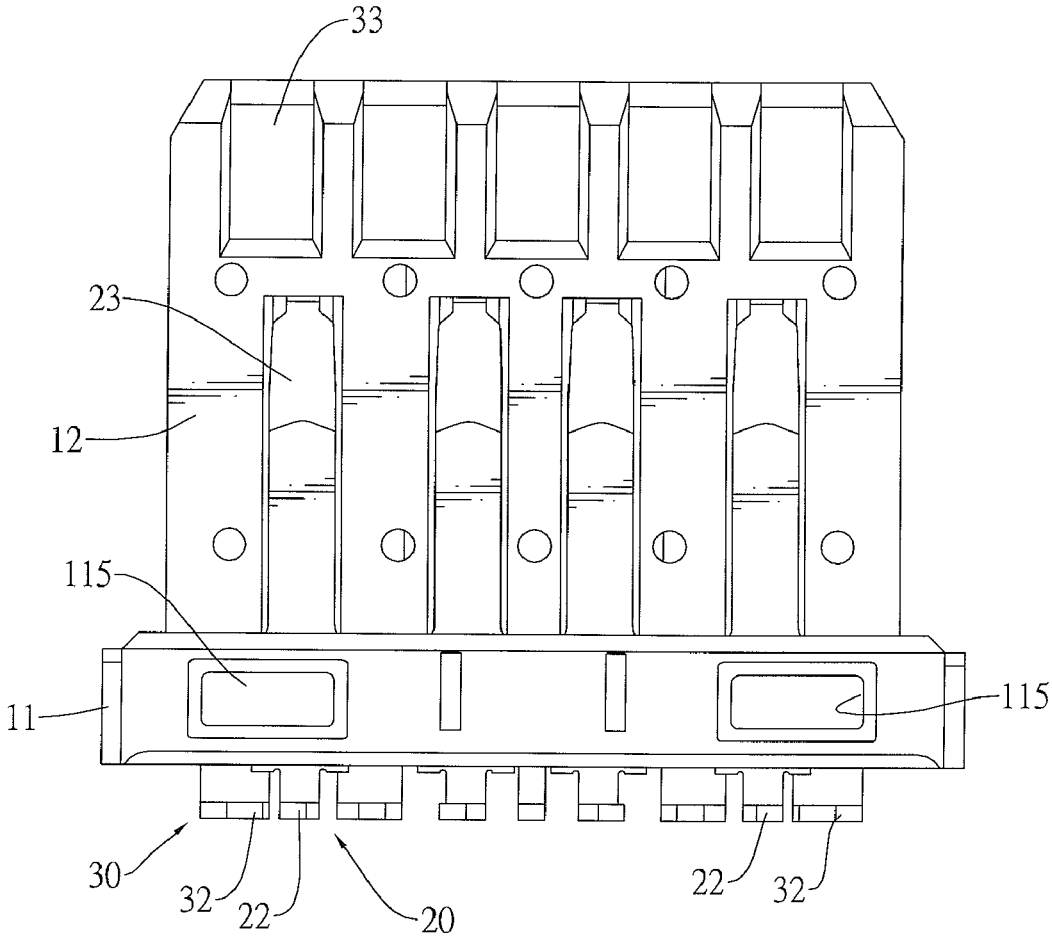
FIG. 8 is a bottom view of the socket connector in FIG. 2.

With further reference to FIGS. 5 to 8, the tongue (12) is formed on and protrudes from the front of the base (11) and has a bottom and a length (L) from 8.3 to 8.46 mm. The length (L) is similar to a tongue of a standard USB 2.0 socket connector and is shorter than a tongue of a standard USB 3.0 socket connector.

The first mounting holes (102) are defined through the base (11) and the tongue (12).

The second mounting holes (103) are defined through the base (11) and the tongue (12).

The first terminals (20) are mounted respectively through and correspond to the first mounting holes (102) of the insulative housing (10) by a press-fitting process, may be four and may be capable of implementing USB 2.0 signal transmission. Each first terminal (20) has a mounting section (21), a soldering section (22) and a contacting section (23).

The mounting section (21) is mounted in a corresponding first mounting hole (102).

The soldering section (22) is a through hole technology (THE) soldering section and is formed on and protrudes perpendicularly down from the mounting section (21) behind the base (11).

The contacting section (23) is formed on and protrudes forward from the mounting section (21) and is mounted on the bottom of the tongue (12).

The second terminals (30) are mounted respectively through and correspond to the second mounting holes (103) of the insulative housing (10) by an insert-molding process, may be five and may be capable of cooperating with the first terminals (20) to implement USB 3.0 signal transmission. Each second terminal (30) has a mounting section (31), a soldering section (32) and a contacting section (33).

The mounting section (31) is mounted in a corresponding second mounting hole (103).

The soldering section (32) is a through hole technology (THE) soldering section and is formed on and protrudes perpendicularly down from the mounting section (31) behind the base (11). Furthermore, the soldering sections (22, 32) of the first and second terminals (20, 30) are arranged in a transverse row relative to the insulative housing (10).

The contacting section (33) is formed on and protrudes forward from the mounting section (31) and is mounted on the bottom of the tongue (12).

The positioning bracket (40) may be L-shaped, is mounted under the base (11) of the insulative housing (10) and has an upright segment (41), a level segment (42), a row of positioning holes (43) and multiple fastening protrusions (45).

The upright segment (41) covers the soldering sections (22, 32) of the first and second terminals (20, 30) to prevent the first and second terminals (20, 30) from interfering with each other.

The level segment (42) is formed on and protrudes perpendicularly forward from the upright segment (41).

The positioning holes (43) are defined through the positioning bracket (40), may be defined through the level segment (42) and are mounted respectively around the soldering sections (22, 32) of the first and second terminals (20, 30).

The fastening protrusions (45) are formed on and protrude upward from the level segment (42) and are mounted respectively in the fastening slots (115) of the base (11) of the insulative housing (10).

The shell (50) may be metal, covers the insulative housing (10), first terminals (20), second terminals (30) and positioning bracket (40) and has a cavity (500), a top plate (51), two side plates (52), a bottom plate (53) and a rear plate (54). The shell (50) may further have multiple resilient positioning tabs (513).

The cavity (500) is defined in the shell (50) and cooperates with the insulative housing (10) to form a socket hole to receive a corresponding plug connector.

The positioning tabs (513) are formed on the top plate (51), extend into the cavity (500) and are mounted respectively in the positioning slots (113).

The socket connector has the following advantages.

1. The soldering sections (22, 32) of the first and second terminals (20, 30) are THE soldering sections and are arranged in one transverse row so that the length of the insulative housing (10) is efficiently decreased. Therefore, the socket connector is compact and lowers a manufacturing cost thereof.

2. The socket connector capable of implementing the USB 3.0 signal transmission has the length of the tongue (12) identical to that of the tongue of the standard USB 2.0 socket connector. Therefore, the total length and volume of the insulative housing (10) are effectively reduced for compact and economical purposes.

3. The positioning slots (113) and the resilient positioning tabs (513) engage with each other to allow the shell (50) to easily and quickly align with and mount to the insulative housing (10).

4. The insulative housing (10) and the positioning bracket (40) are assembled quickly through the fastening slots (115) and fastening protrusion (45), and the positioning bracket (40) securely holds and prevents the soldering sections (22, 32) from bending and interfering with each other.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A socket connector comprising:

an insulative housing having a base having a top, a bottom and a front;

a tongue formed on and protruding forward from the base and having a bottom;

multiple first mounting holes defined through the base and the tongue; and multiple second mounting holes defined through the base and the tongue;

multiple first terminals mounted respectively through and corresponding to the first mounting holes and each first terminal having a mounting section mounted in a corresponding first mounting hole;

a soldering section formed as a through hole technology soldering section, formed on and protruding perpendicularly down from the mounting section behind the base; and a contacting section formed on and protruding forward from the mounting section and mounted on the bottom of the tongue;

multiple second terminals mounted respectively through and corresponding to the second mounting holes and each second terminal having a mounting section mounted in a corresponding second mounting hole;

a soldering section formed as a through hole technology soldering section, formed on and protruding perpendicularly down from the mounting section behind the base; and a contacting section formed on and protruding forward from the mounting section and mounted on the bottom of the tongue;

a positioning bracket mounted under the base of the insulative housing and having a row of positioning holes defined through the positioning bracket and are mounted respectively around the soldering sections of the first and second terminals;

a shell covering the insulative housing, first terminals, second terminals and positioning bracket and having a cavity defined in the shell and cooperating with the insulative housing to form a socket hole; and the soldering sections of the first and second terminals arranged alternately in a same row and transversely relative to the insulative housing.

2. The socket connector as claimed in claim 1, wherein the first terminals are four and capable of implementing USB 2.0 signal transmission; and the second terminals are five and capable of cooperating with the first terminals to implement USB 3.0 signal transmission.

3. The socket connector as claimed in claim 1, wherein a length of the tongue is from 8.3 to 8.46 mm.

4. The socket connector as claimed in claim 2, wherein a length of the tongue is from 8.3 to 8.46 mm.

5. The socket connector as claimed in claim 1, wherein the base further has multiple positioning slots defined in the top of the base; and the shell has a top plate, two side plates, a bottom plate, a rear plate and multiple positioning tabs formed on the top plate, extending into the cavity and mounted respectively in the positioning slots.

6. The socket connector as claimed in claim 2, wherein the base further has multiple positioning slots defined in the top of the base; and the shell has a top plate, two side plates, a bottom plate, a rear plate and multiple positioning tabs formed on the top plate, extending into the cavity and mounted respectively in the positioning slots.

7. The socket connector as claimed in claim 1, wherein the base further has multiple fastening slots defined in the bottom of the base;

the positioning bracket has an upright segment covering the soldering sections of the first and second terminals;

a level segment formed on and protruding forward from the upright segment; and multiple fastening protrusions formed on and protruding upward from the level segment and mounted respectively in the fastening slots; and the positioning holes are defined through the level segment.

8. The socket connector as claimed in claim 2, wherein the base further has multiple fastening slots defined in the bottom of the base;

the positioning bracket has an upright segment covering the soldering sections of the first and second terminals;

a level segment formed on and protruding forward from the upright segment; and multiple fastening protrusions formed on and protruding upward from the level segment and mounted respectively in the fastening slots; and the positioning holes are defined through the level segment.

9. The socket connector as claimed in claim 1, wherein the first terminals are mounted on the insulative housing by a press-fitting process; and the second terminals are mounted on the insulative housing by an insert-molding process.

10. The socket connector as claimed in claim 2, wherein the first terminals are mounted on the insulative housing by a press-fitting process; and the second terminals are mounted on the insulative housing by an insert-molding process.

* * * * *